US006834897B1

(12) United States Patent
Walker

(10) Patent No.: US 6,834,897 B1
(45) Date of Patent: Dec. 28, 2004

(54) LOCK STRIKER PLATE FOR ATTACHING TO A DOORJAMB

(76) Inventor: Noel G. Walker, 37 Harding Ave., Morton, PA (US) 19079

( * ) Notice: Subject to any disclaimer, the term of this patent is extended or adjusted under 35 U.S.C. 154(b) by 0 days.

(21) Appl. No.: 10/425,493

(22) Filed: Apr. 29, 2003

(51) Int. Cl.[7] ..... E05B 15/02
(52) U.S. Cl. ..... 292/340; 292/341
(58) Field of Search ..... 292/340, 341, 292/341.11, 341.13, DIG. 2

(56) References Cited

U.S. PATENT DOCUMENTS

| | | | | | |
|---|---|---|---|---|---|
| 3,405,962 | A | | 10/1968 | Sushan | |
| 3,592,498 | A | | 7/1971 | Raccuglia, Sr. | |
| 3,815,945 | A | * | 6/1974 | Lamphere | 292/340 |
| 3,967,845 | A | * | 7/1976 | Governale | 292/340 |
| 4,130,311 | A | | 12/1978 | Sushan | |
| 4,171,837 | A | | 10/1979 | McRoy | |
| 4,383,709 | A | * | 5/1983 | Ronan | 292/346 |
| 4,717,185 | A | * | 1/1988 | Hartley | 292/340 |
| 4,802,701 | A | * | 2/1989 | Mazie | 292/340 |
| 4,809,400 | A | * | 3/1989 | Allen | 16/82 |
| 5,074,606 | A | | 12/1991 | Priola et al. | |
| 5,088,780 | A | * | 2/1992 | Doherty | 292/346 |
| D351,781 | S | | 10/1994 | DeWitt | |
| 5,581,948 | A | * | 12/1996 | Simonsen | 49/460 |

* cited by examiner

*Primary Examiner*—Gary Estremsky
(74) *Attorney, Agent, or Firm*—Richard L. Miller

(57) ABSTRACT

A lock striker plate. A first portion attaches to a doorjamb, over a bolt-receiving blind bore therein. A second portion extends perpendicularly forwardly from the first portion, contacts, and extends forwardly past, a stop of the doorjamb, and blocks insertion of a thin card into the bolt-receiving blind bore therein. A third portion extends perpendicularly sidewardly from the second portion, after the stop of the doorjamb and attaches thereto. In one embodiment, the third portion extends forwardly of the first portion so as to lie in a plane parallel to that of the first portion when the stop of the doorjamb is not a separate piece therefrom. In another embodiment, the third portion lies in a same plane as that of the first portion when the stop of the doorjamb is a separate piece therefrom.

6 Claims, 1 Drawing Sheet

LOCK STRIKER PLATE FOR ATTACHING TO A DOORJAMB

BACKGROUND OF THE INVENTION

1. Field of the Invention

The present invention relates to a lock striker plate. More particularly, the present invention relates to a lock striker plate for attaching to a doorjamb.

2. Description of the Prior Art

Numerous innovations for door security devices have been provided in the prior art that will be described. Even though these innovations may be suitable for the specific individual purposes to which they address, however, they differ from the present invention.

A FIRST EXAMPLE, U.S. Pat. No. 3,405,962 to Sushan teaches various types of door lock guards and door lock guard assemblies for door lock sets having a spring bolt, dead-bolt or both. The lock guards are T-shaped in cross section, having unequal flanges and angles, having several different thicknesses. One flange portion extends across the opening between the door and the doorjamb, preventing the insertion of a thin flexible metal or plastic strip or tool between the door and the jamb, to force back the spring bolt, the other portion of such flange extending back over the face of the door. The lock guard may have another flanged portion which extends the T end outwardly of the other side of the door for interlocking into a guarded striker plate.

A SECOND EXAMPLE, U.S. Pat. No. 3,592,498 to Raccuglia Sr. teaches a jimmy-proof door guard that comprises an assembly of a channel member and an angle bar. The channel member is secured laterally to a doorjamb and the angle bar is secured to the outside of the door. The assembly is located at the height of the lock on the door. When the door is closed, the angle bar fits into the channel member so that the bolt of lock cannot be reached and pried open. The channel member and bar are so arranged that the angle bar covers holding the channel member of the doorjamb and the channel member covers screws holding the angle bar on the doorA THIRD EXAMPLE, U.S. Pat. No. 4,130,311 to Sushan teaches improved lock blocking plates and doorjamb striker plates for use with entrance doors, the plates being utilized to prevent forcing or jacking open of dead bolt or spring bolt latches, together or singularly, while preventing inclement weather elements including rain water and wind from being received into the space existing between the door end face and the doorjamb. The invention includes several alternate embodiments for uses with single doors that open in or out and double doors and provide for rain drainage, wind and rain deflection and a guard plate to prevent unauthorized opening of a dead bolt or spring latch bolt found in conventional doors and doorjambs. Also included in the improvements is a downward and outward angularly formed top guard plate edge which allows rain water which might otherwise seep into the locking mechanism to drain outwardly and downwardly for preventing moisture in the lock operating mechanism. An additional improvement includes the utilization of full length interlocking door guard strips having an outer deflector surface to divert wind driven rain away from the doorjamb spacing of the entrance doors.

A FOURTH EXAMPLE, U.S. Pat. No. 4,171,837 to McRoy teaches a burglary-resistant apparatus for denying access to door locks through a door crevice that is adapted for mounting on a doorjamb adjacent one or more door locks and comprises a vertically elongate blocking plate disposed over the crevice between the doorjamb and a door, which includes flat surface portions extending over marginal portions of the door and substantially into a groove within the doorjamb thereby making it especially difficult to gain access to the crevice by circumventing the blocking plate. A vertically elongate locking plate has one vertical edge thereof secured to the blocking plate and extends perpendicularly therefrom to form a rigid structural unit having a generally T-shaped cross section. The locking plate is adapted to be secured to the doorjamb adjacent the door crevice and cooperates with the edge of the blocking plate seated within the groove of the doorjamb to provide particularly rigid mounting of the blocking plate to prevent dislodgement of the latter even under the influence of burglary tools.

A FIFTH EXAMPLE, U.S. Pat. No. 5,074,606 to Priola et al. teaches an assembly for improving closed door security that comprises a door having a unitary first member comprising a first elongated flat plate portion lying substantially entirely in a first plane and a first elongated flat blade portion lying substantially entirely in a second plane, the planes being parallel with the end face of said door, the unitary member secured on the door with the blade portion spanning the latch bolt and extending parallel along the end face substantially entirely between the latch bolt and the outside door edge.

A doorjamb having a unitary second member comprising a second elongated flat plate portion and having an opening exposing a latch bolt recess, and lying substantially entirely in a third plane and a second elongated flat blade portion lying substantially entirely in a fourth plane the third and fourth planes being substantially parallel with each other and with the first and said second planes, the second plate and second blade portions having an elongated slot therebetween, and wherein the first flat plate portion, first flat blade portion, second flat plate portion, and second flat blade portion are positioned between the strike face surface and the end face, and the first and second flat blade portions are overlapped, when the door is closed in the doorjamb.

A SIXTH EXAMPLE, U.S. Pat. No. Des. 351,781 to DeWitt teaches the ornamental design of a door striker plate.

It is apparent that numerous innovations for door security devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a lock striker plate for attaching to a doorjamb that avoids the disadvantages of the prior art.

ANOTHER OBJECT of the present invention is to provide a lock striker plate for attaching to a doorjamb that is simple and inexpensive to manufacture.

STILL ANOTHER OBJECT of the present invention is to provide a lock striker plate for attaching to a doorjamb that is simple to use.

BRIEFLY STATED, STILL YET ANOTHER OBJECT of the present invention is to provide a lock striker plate. A first portion attaches to a doorjamb, over a bolt-receiving blind bore therein. A second portion extends perpendicularly forwardly from the first portion, contacts, and extends forwardly past, a stop of the doorjamb, and blocks insertion of a thin card into the bolt-receiving blind bore therein. A third portion extends perpendicularly sidewardly from the second portion, after the stop of the doorjamb and attaches thereto. In one embodiment, the third portion extends forwardly of the first portion so as to lie in a plane parallel to that of the first portion when the stop of the doorjamb is not a separate piece therefrom. In another embodiment, the third portion lies in a same plane as that of the first portion when the stop of the doorjamb is a separate piece therefrom.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figure 1:
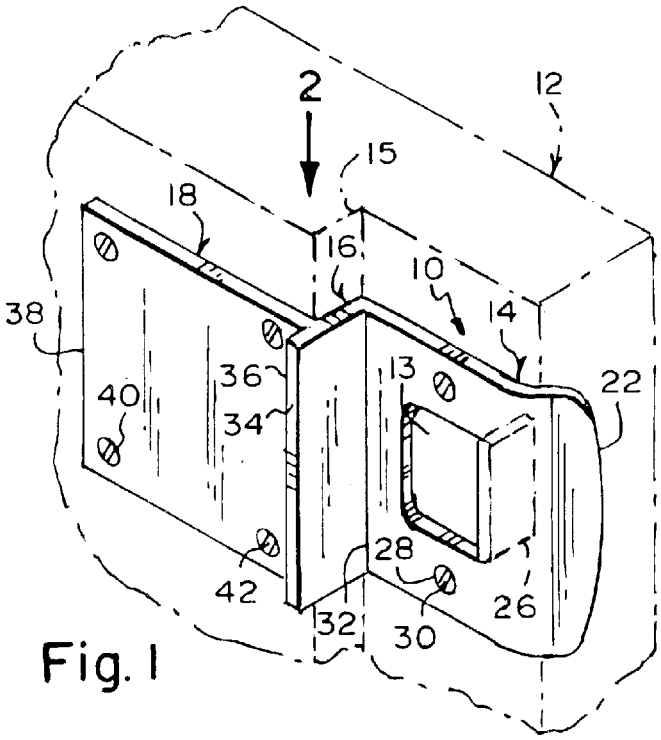
FIG. 1 is a diagrammatic perspective view of a first embodiment of the present invention in use.

10 lock striker plate of present invention for attaching to doorjamb 12
12 doorjamb
13 bolt-receiving blind bore in doorjamb 12
14 first portion for attaching to doorjamb 12, over bolt-receiving blind bore 13 in doorjamb 12
15 stop of doorjamb 12
16 second portion for contacting, and extending past, stop 15 of doorjamb 12 and blocking insertion of thin card 20 into bolt-receiving blind bore 13 in doorjamb 12
18 third portion for attaching to doorjamb 12
20 thin card
22 first edge of first portion 14 for rolling around doorjamb 12 and facilitating insertion of bolt 24 into bolt-receiving blind bore 13 in doorjamb 12
24 bolt of door 25
25 door
26 lip of first portion 14 for positioning in, and helping define, bolt-receiving blind bore 13 in doorjamb 12
28 plurality of through bores in first portion 14 for receiving screws 30 for mounting first portion 14 to doorjamb 12
30 screws of first portion 14 for mounting first portion 14 to doorjamb 12
32 second edge of first portion 14
34 edge of second portion 16
36 face of second portion 16
38 edge of third portion 18
40 plurality of through bores in third portion 18 for receiving screws 42 for mounting third portion 18 to doorjamb 12
42 screws of third portion 16 for mounting third portion 18 to doorjamb 12

Second Embodiment

110 lock striker plate
112 doorjamb
114 first portion
115 stop of doorjamb 112
118 third portion

DESCRIPTION OF THE PREFERRED EMBODIMENT

Referring now to the figures, in which like numerals indicate like parts, and particularly to FIG. 1, a first embodiment of the lock striker plate of the present invention is shown generally at 10 for attaching to a doorjamb 12, wherein the doorjamb 12 has a bolt-receiving blind bore 13 and a stop 15.

Figure 2:
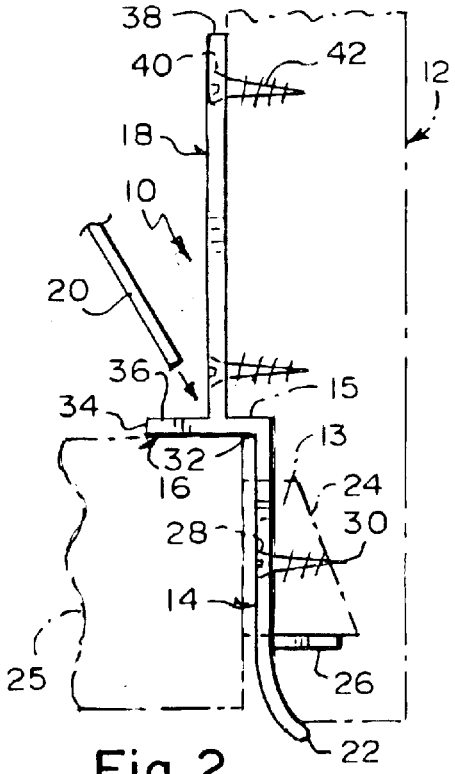
FIG. 2 is a diagrammatic toop plan view taken generally in the direction of arrow 2 in FIG. 1.

The configuration of the lock striker plate 10 can best be seen in FIGS. 1 and 2, and as such, will be discussed with reference thereto.

The lock striker plate 10 is one-piece and comprises a first portion 14, a second portion 16, and a third portion 18. The first portion 14 is for attaching to the doorjamb 12, over the bolt-receiving blind bore 13 in the doorjamb 12. The second portion 16 extends forwardly from the first portion 14 and is for contacting the stop 15 of the doorjamb 12 and blocking insertion of a thin card 20 into the bolt-receiving blind bore 13 in the doorjamb 12. The third portion 18 extends sidewardly from the second portion 16, after the stop 15 of the doorjamb 12, and is for attaching to the doorjamb 12.

The first portion 14 is flat, and has a first edge 22 that is free, rolled, and is for rolling around the doorjamb 12 and facilitating insertion of a bolt 24 of a door 25 into the bolt-receiving blind bore 13 in the doorjamb 12, a lip 26 for positioning in, and helping define, the bolt-receiving blind bore 13 in the doorjamb 12, a plurality of through bores 28 for receiving screws 30 for mounting the first portion 14 to the doorjamb 12, and a second edge 32 that is opposite to the first edge 22 thereof.

The second portion 16 is flat, and extends perpendicularly forwardly from the second edge 32 of the first portion 14 to an edge 34 that is free, and has a face 36 that faces opposite to the first portion 14. The second portion 16 is for contacting, and extending forwardly past, the stop 15 of the doorjamb 12.

The third portion 18 is flat, extends perpendicularly sidewardly from the face 36 of the second portion 16, after the stop 15 of the doorjamb 12, to an edge 38 that is free, has a plurality of through bores 40 for receiving screws 42 for mounting the third portion 18 to the doorjamb 12, and is for attaching to the doorjamb 12.

The third portion 18 extends perpendicularly from the face 36 of the second portion 16, forwardly of the first portion 14 so as to lie in a plane parallel to that of the first portion 14, for accommodating for the stop 15 of the doorjamb 12 when the stop 15 of the doorjamb 12 is not a separate piece of the doorjamb 12.

Figure 3:
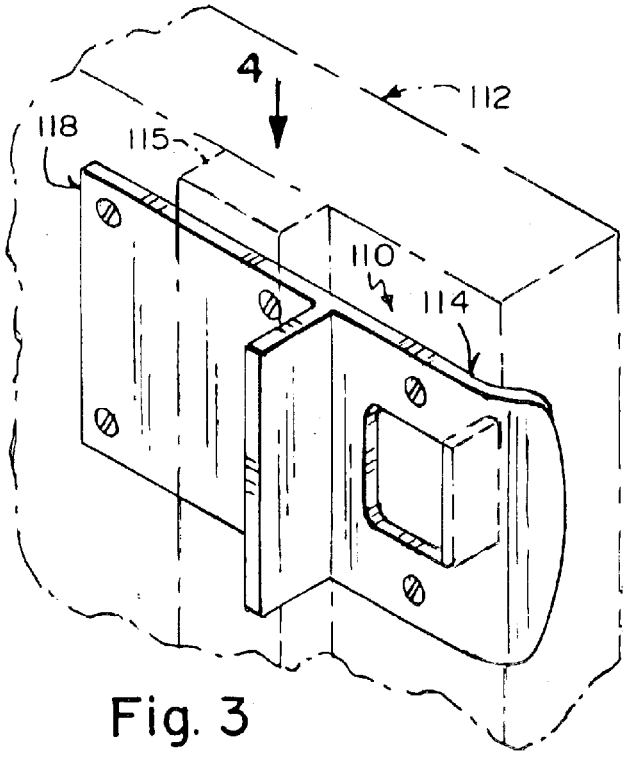
FIG. 3 is a diagrammatic perspective view of a second embodiment of the present invention in use.
Figure 4:
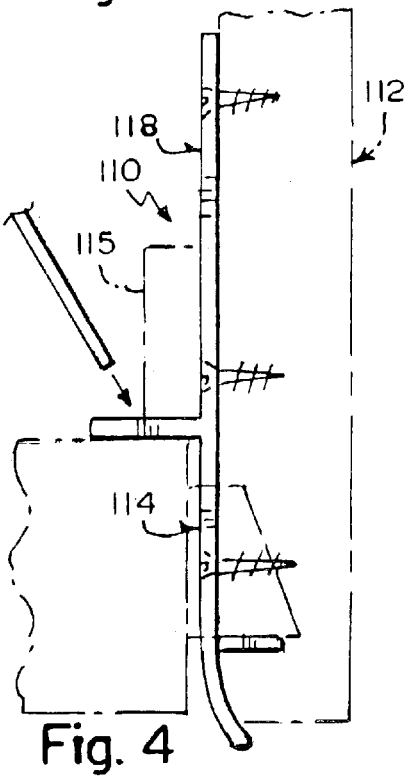
FIG. 4 is a diagrammatic top plan view taken generally in the direction of arrow 4 in FIG. 3.

The configuration of a second embodiment of the lock striker plate. 110 can best be seen in FIGS. 3 and 4, and as such, will be discussed with reference thereto.

The lock striker plate 110 is identical to the lock striker plate 10, except that the third portion 11B lies in a same plane as that of the first portion 114 when the stop 115 of the doorjamb 112 is a separate piece of the doorjamb 112 so as to allow the third portion 118 to be attached to the doorjamb 112 prior to, and therefore lie under, the stop 115 of the doorjamb 112.

It will be understood that each of the elements described above, or two or more together, may also find a useful application in other types of constructions differing from the types described above.

While the invention has been illustrated and described as embodied in a striker plate for attaching to a doorjamb, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A lock striker plate for attaching to a door jamb, wherein the doorjamb has a bolt-receiving blind bore and a stop, said plate comprising:

a) a first portion;

wherein said first portion is for attaching to the doorjamb over the bolt-receiving blind bore;

wherein the first portion has a first edge that extends free of the plate;

wherein said first edge of said first portion is rolled, for rolling around an edge of the door jamb for facilitating insertion of a bolt of a door into the bolt-receiving blind bore in the door jamb; and wherein said first portion has a second edge that is opposite to said first edge thereof;

b) a second portion;

wherein said second portion is completely flat;

wherein said second portion extends perpendicularly forwardly from said second edge of said first portion to an edge;

wherein said edge of said second portion is free of any other part of said plate;

wherein said second portion has a face on a side opposite to the direction that said first portion extends from said second portion;

wherein said face of said second portion is for contacting the stop of the doorjamb and for extending forwardly past the stop of the doorjamb; and wherein said second portion is for blocking insertion of a thin card into the bolt-receiving blind bore in said doorjamb;

c) a third portion;

wherein said third portion extends perpendicularly sidewardly from a general mid-portion of said face of said second portion to define an edge of the third portion that is free of any other part of said plate, and is not bent; and wherein said first portion, said second portion, and said third portion are formed as one-piece.

2. The plate as defined in claim 1, wherein said first portion has a lip;

wherein said lip of said first portion is for positioning in the bolt-receiving blind bore in the doorjamb; and wherein said lip of said first portion is for helping define the bolt-receiving blind bore in the doorjamb.

3. The plate as defined in claim 1, wherein said first portion has a plurality of through bores;

wherein said plurality of through bores in said first portion are for receiving screws; and wherein the screws are for mounting said first portion to the doorjamb.

4. The plate as defined in claim 1, wherein said third portion is flat.

5. The plate as defined in claim 1, wherein said third portion has a plurality of through bores;

wherein said plurality of through bores in said third portion are for receiving screws; and wherein said screws are for mounting said third portion to the doorjamb.

6. The plate as defined in claim 1, wherein said third portion extends forwardly of said first portion so as to lie in a plane parallel to that of said first portion, for accommodating for the stop of the doorjamb when the stop of the doorjamb is not a separate piece of the doorjamb.

* * * * *